US006279272B1

(12) United States Patent
Nill, Jr.

(10) Patent No.: US 6,279,272 B1
(45) Date of Patent: Aug. 28, 2001

(54) FULL COVERAGE VENT PIPE FLASHING

(76) Inventor: Andrew J. Nill, Jr., 12 Hampton Dr., Center Moriches, NY (US) 11934

( * ) Notice: Subject to any disclaimer, the term of this patent is extended or adjusted under 35 U.S.C. 154(b) by 0 days.

(21) Appl. No.: 09/710,308

(22) Filed: Nov. 10, 2000

(51) Int. Cl.[7] ..... E04D 1/36

(52) U.S. Cl. ..... 52/58; 52/60; 52/198; 285/43

(58) Field of Search ..... 52/58, 60, 198, 52/199, 219; 285/43, 44, 45, 397; 403/188, 192, 199, 286, 292, 293, 341

(56) References Cited

U.S. PATENT DOCUMENTS 2,985,091 * 5/1961 Hatcher ..... 454/47
3,313,559 * 4/1967 Kifer ..... 285/43
5,970,667 * 10/1999 Thaler ..... 52/219

FOREIGN PATENT DOCUMENTS 94-21872 * 9/1994 (DE) .

* cited by examiner

*Primary Examiner*—Carl D. Friedman
*Assistant Examiner*—Bennett Porterie
(74) *Attorney, Agent, or Firm*—Galgano & Burke

(57) ABSTRACT

A vent pipe flashing system includes a lower flange, a resilient boot portion and a matching sleeve portion. According to a first embodiment, the lower flange is plastic or metal, the resilient boot portion is plastic or rubber, and the sleeve portion is metal or plastic and has a diameter large enough to slide over the vent pipe and a length about one inch longer than the vent pipe. The top of the sleeve is crimped to hook over the top end of the vent pipe and the bottom of the sleeve is coupled to the boot by crimping. According to a second embodiment, the lower flange includes a metal or plastic roof flange and a rubber gasket having a skirt fixedly seats atop the roof flange. The bottom end of the sleeve portion is crimped over the rubber gasket. The upper ends of the sleeve portion and the vent pipe are covered by a cap having an inverted U-section. According to either embodiment, multiple (telescoping) sleeve portions may be provided and (optionally) coupled to each other by crimping. According to either embodiment of the invention, the components are preferably color matched and made available in a variety of sizes to fit different size vent pipes.

9 Claims, 5 Drawing Sheets

FULL COVERAGE VENT PIPE FLASHING

BACKGROUND OF THE INVENTION

1. Field of the Invention

The invention relates to roofing flashing. More particularly, the invention relates to a flashing system for a plumbing stack vent pipe.

2. State of the Art

Vent pipes are typically provided in roofs of residential buildings to permit the escape of gas-phase materials. Indeed, most residential building codes require that building's sewer connections be provided with vents so that obnoxious and potentially hazardous fumes are not released into the building. These connections are typically achieved by extending a pipe through the roof so that it opens upwardly to the sky. A seal is placed around the outside of the pipe where it passes through the roof to prevent rainwater or other precipitation from entering the building. However, no provision is made to prevent rainwater from entering the pipe itself, the assumption being that since the pipe is connected to the sewage system, little harm is done in permitting leakage into the pipe.

A common boot-type flashing for sealing the space surrounding a vent pipe is disclosed in U.S. Pat. No. 3,313,559. The flashing consists of a sheet of aluminum or steel with a central opening sized to allow a vent pipe to pass through it, and a frustoconical rubber gasket which seals the space between the pipe and the sheet. The prior art vent pipe flashing works reasonably well most of the time. However, leaks can and do occur in these types of seals when the rubber gasket becomes loose.

SUMMARY OF THE INVENTION

It is therefore an object of the invention to provide a vent pipe flashing system which is more reliable than the prior art systems.

It is also an object of the invention to provide a vent pipe flashing system which is inexpensive.

It is another object of the invention to provide a vent pipe flashing system which is easy to install.

It is still another object of the invention to provide a vent pipe flashing system which is aesthetically pleasing.

In accord with these objects which will be discussed in detail below, the vent pipe flashing system of the present invention includes a lower flange, a boot portion and a matching sleeve portion. According to a first embodiment, the boot portion is rubber, the sleeve portion is a metal tube having a diameter large enough to slide over the vent pipe and a length about one inch longer than the vent pipe. The top of the sleeve is crimped to hook over the top end of the vent pipe and the bottom of the sleeve is coupled to the boot preferably by crimping. According to a second embodiment, the boot portion comprises a rubber gasket having a skirt which seats atop the roof flange. The bottom end of the sleeve portion is crimped over the rubber gasket. The upper ends of the sleeve portion and the vent pipe are covered by a cap having an inverted U-section. According to either embodiment, multiple (telescoping) sleeve portions may be provided and (optionally) coupled to each other by crimping. According to either embodiment of the invention, the components are preferably color matched and made available in a variety of sizes to fit different size vent pipes.

One of the advantages of the invention is that the horizontal sealing required by the prior art gasket is replaced by a vertical sealing among the flange and the sleeve via the boot. This vertical sealing is less prone to separating as it is held in place by gravity, is not affected by expansion and contraction, and is aesthetically pleasing.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
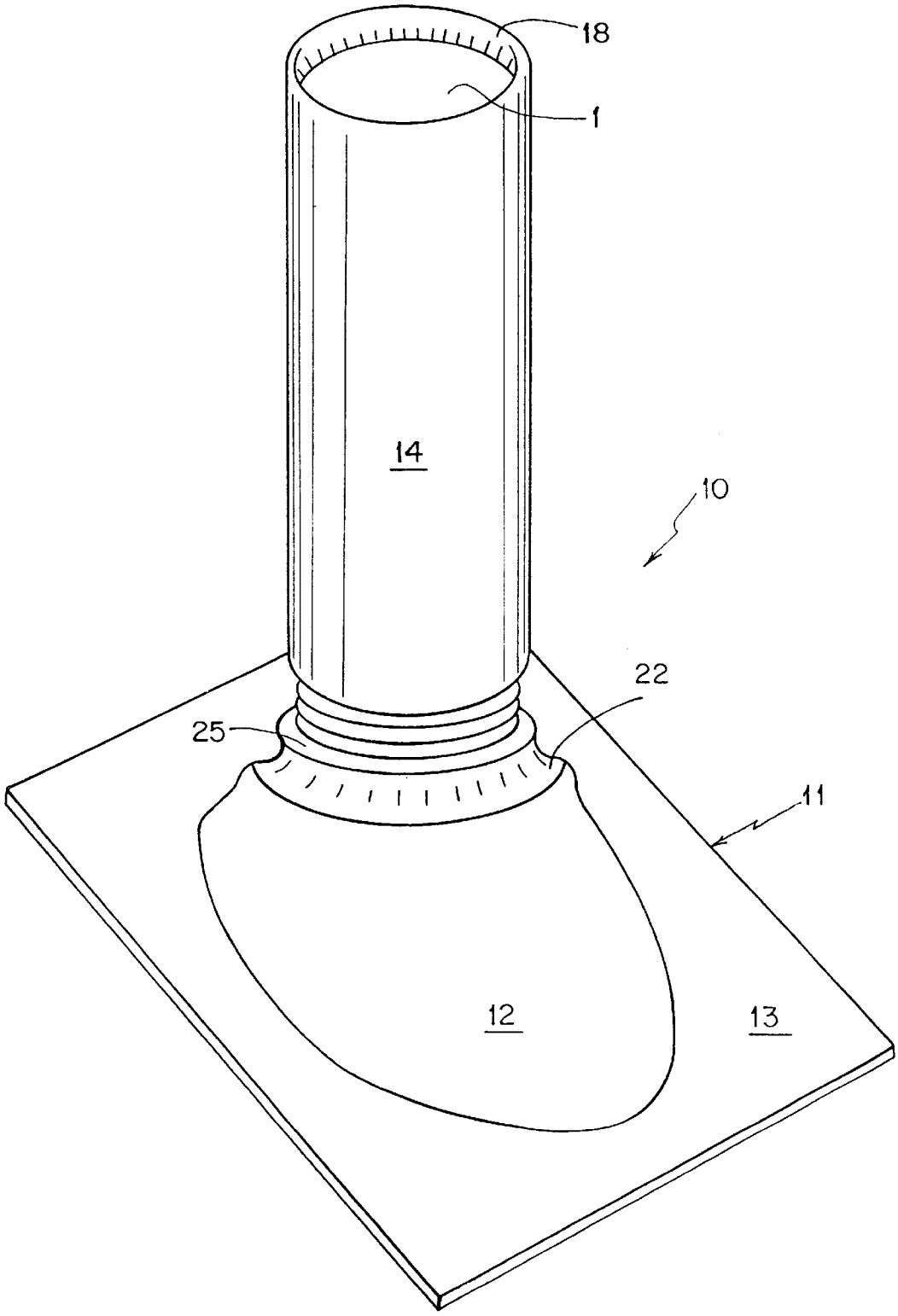
FIG. 1 is a perspective view of a first embodiment of the invention.
Figure 2:
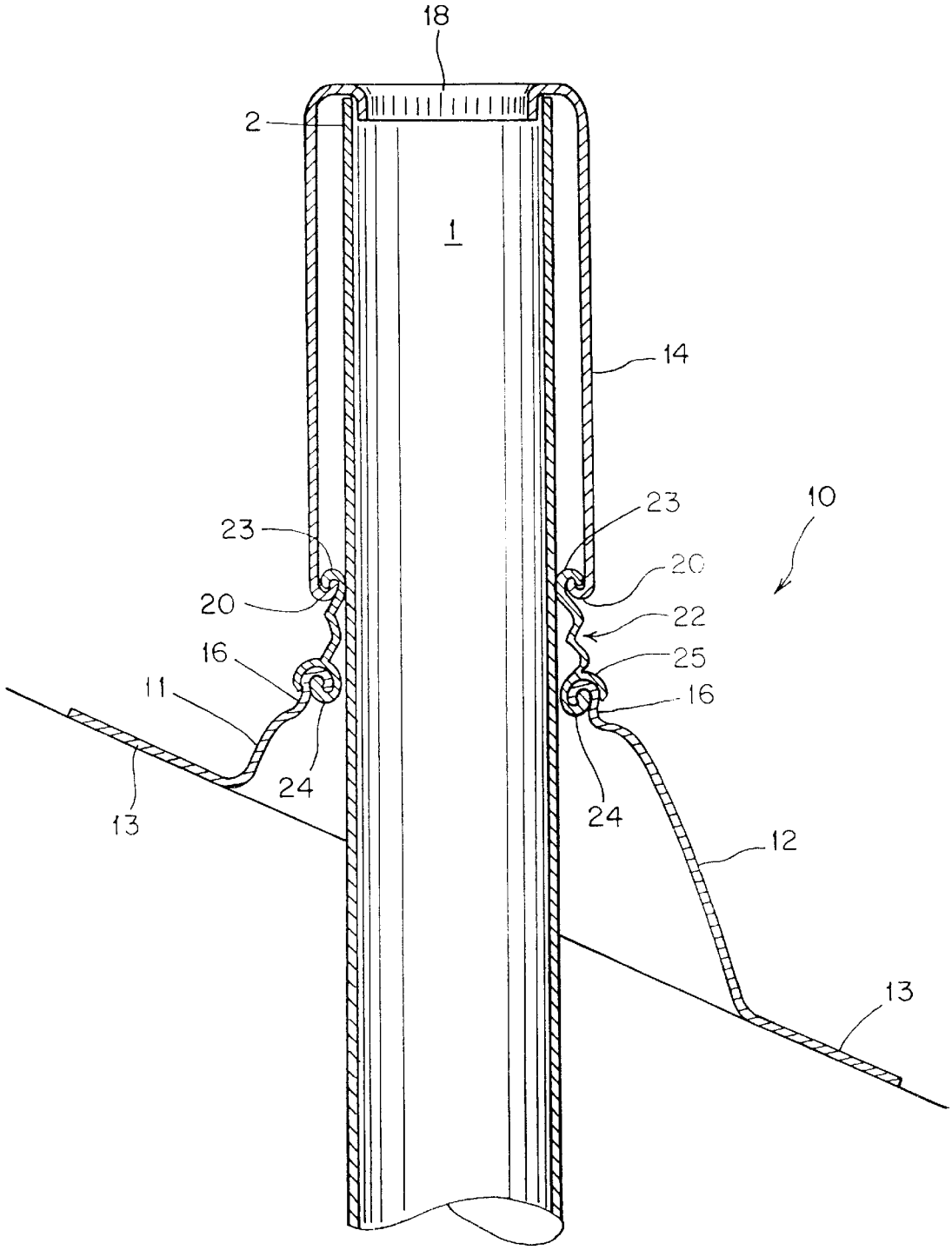
FIG. 2 is a vertical cross-sectional view of the first embodiment of the invention.

Referring now to FIGS. 1 and 2, a first embodiment of a vent pipe flashing system 10 includes a lower plastic or metal flange 11 having a raised central hub 12 having a central opening and an outer peripheral, generally planar flange 13, and an upper metal or plastic tubular sleeve portion 14, which are joined together by a flexible (rubber or plastic) boot portion 22 preferably made of neoprene. The lower planar, peripheral flange 13 is designed to reside under roofing material (e.g. shingles, not shown) when installed. The tubular sleeve portion 14 is dimensioned to have a diameter large enough to slide over the vent pipe 1 and a length about one inch longer than the vent pipe. The top 18 of the sleeve 14 is crimped to hook over the top end 2 of the vent pipe 1. As seen best in FIG. 2, the bottom end 20 of sleeve 14 is coupled to the upper end of metal sleeve 16 by the boot 22.

According to a presently preferred aspect of the first embodiment, the bottom end 20 of the sleeve 14 is provided with a J-shaped flange and the upper end 16 of central hub 12 is provided with an inverted J-shaped flange. The two flanges are joined by complementary-configurational J-shaped ends 23 and 24, respectively, of generally C-shaped boot 22. Preferably, boot 22 is further provided with an annular tapered skirt 25 which is draped over the upper end 16 of central hub 12 so as to direct any water away from the joint defined by the J-shaped flanges of upper end 16 and bottom end 20.

Figure 3:
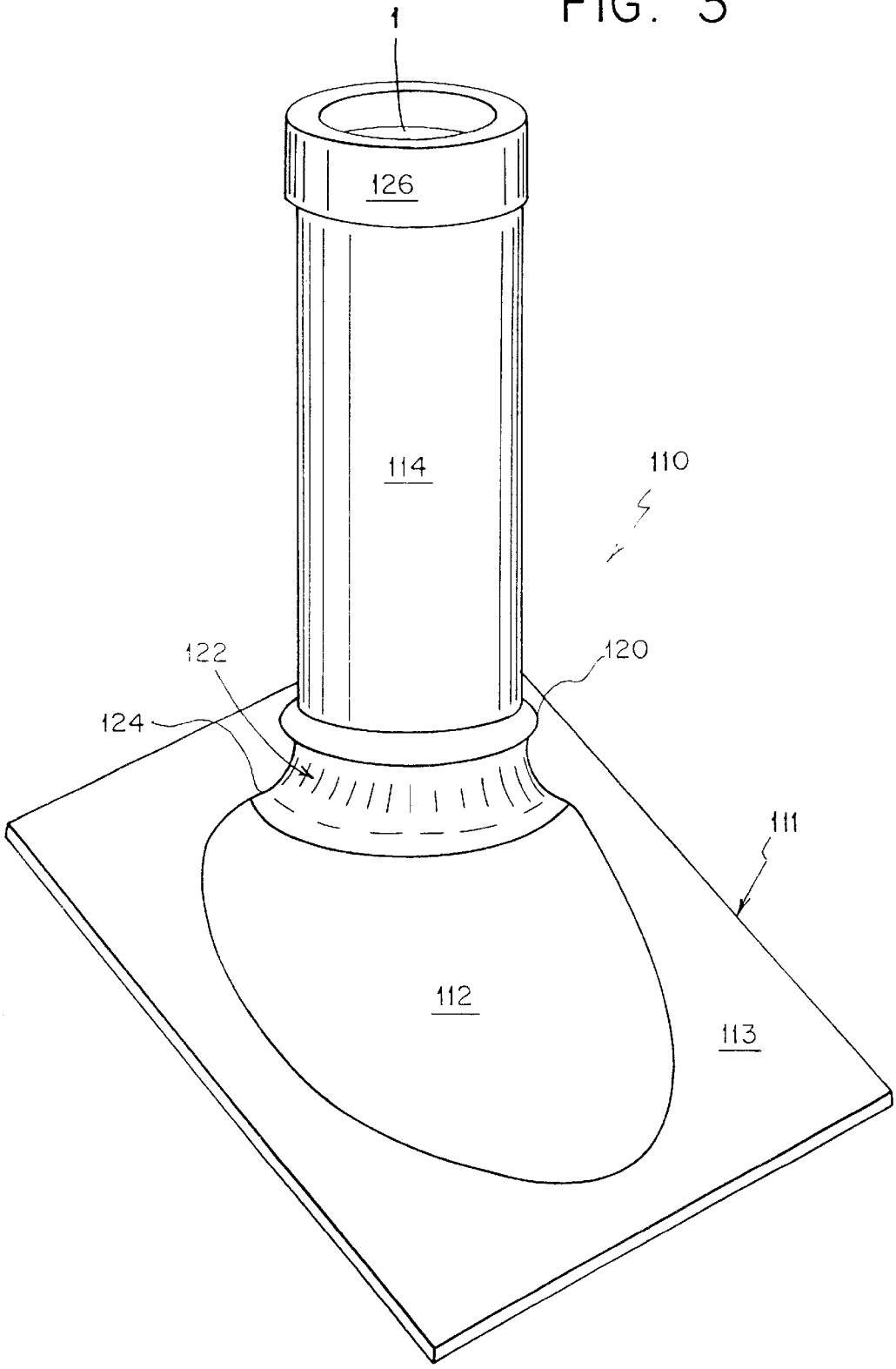
FIG. 3 is a perspective view of a second embodiment of the invention.
Figure 4:
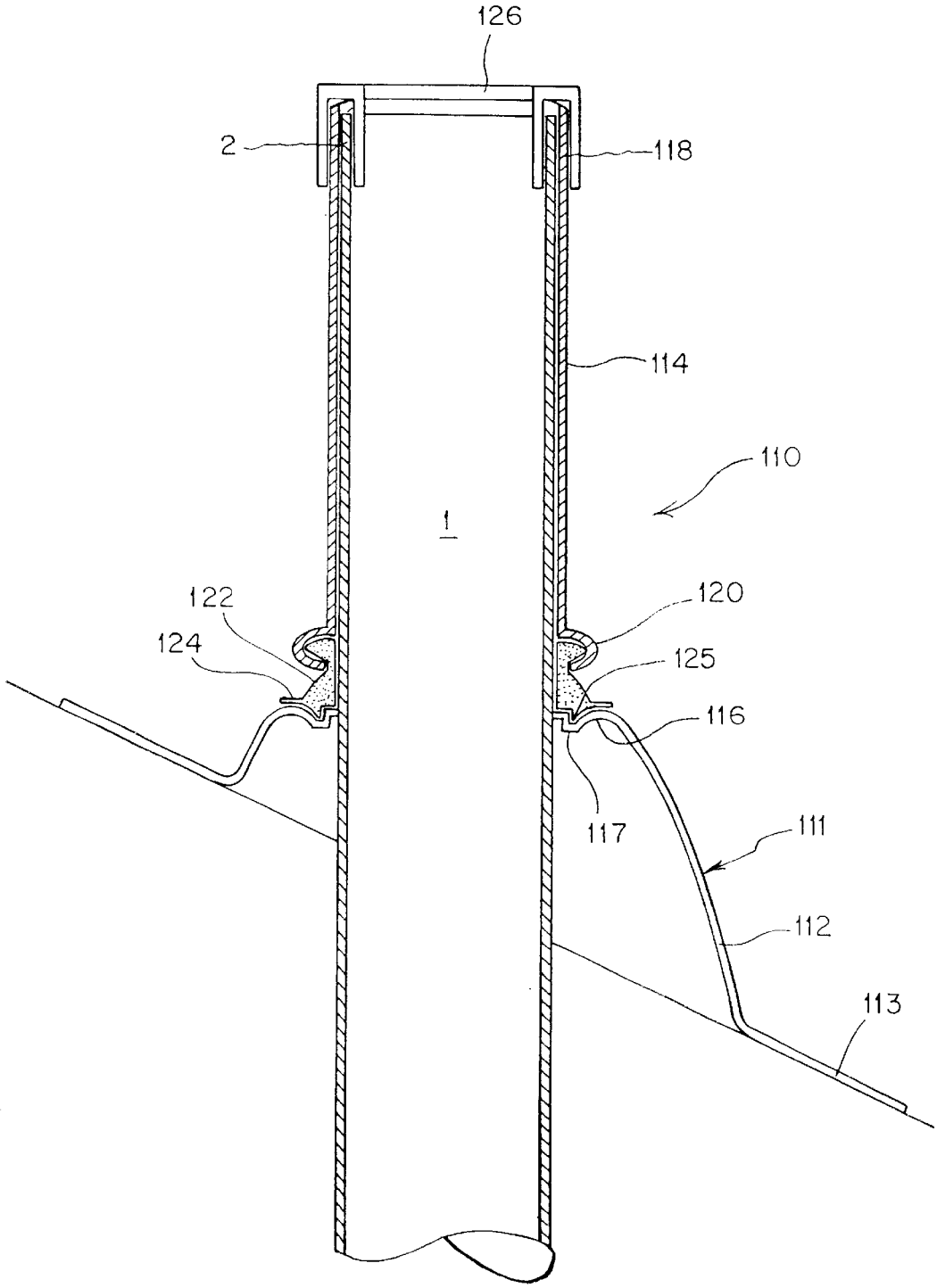
FIG. 4 is a vertical cross-sectional view of the second embodiment of the invention.

Turning now to FIGS. 3 and 4, a second embodiment of a vent pipe flashing system 110 includes a rigid (metal or PVC) lower flange 111 and a (metal or PVC) sleeve portion 114, joined together by a sealing (rubber or plastic) gasket 122, and an end cap 126. The lower flange 111 is comprised of a raised, central hub 112 having a central opening which is joined to a peripheral, planar flange 113. The planar flange 113 is designed to reside under roofing material (e.g. shingles, not shown) when installed. The gasket 122 is seated on (or crimped to) the upper end 116 of the central hub and is provided with a skirt 124 which overlies upper end 116 and serves to direct water away from gasket 122 and down over central hub 112. The bottom end 120 of the upper sleeve portion 114 is crimped over the rubber gasket 122. The upper end 118 of the sleeve portion 114 and the vent pipe 1 are covered by a cap 126 which is engaged therewith in a friction fit manner. The cap has an inverted U-section which covers the space between the space between the upper end 118 of the sleeve portion 114 and the vent pipe 1.

As seen best in FIG. 4, the lower end of gasket 122 is provided with a downwardly depending annular bead 125 which is supported in a complementary-configured pinch joint or fitting 117 of central hub 112. The rubber gasket 122 also gives the vent flashing adjustability relative to different roof pitches (i.e., flat to various-pitched roof angles)

Figure 5:
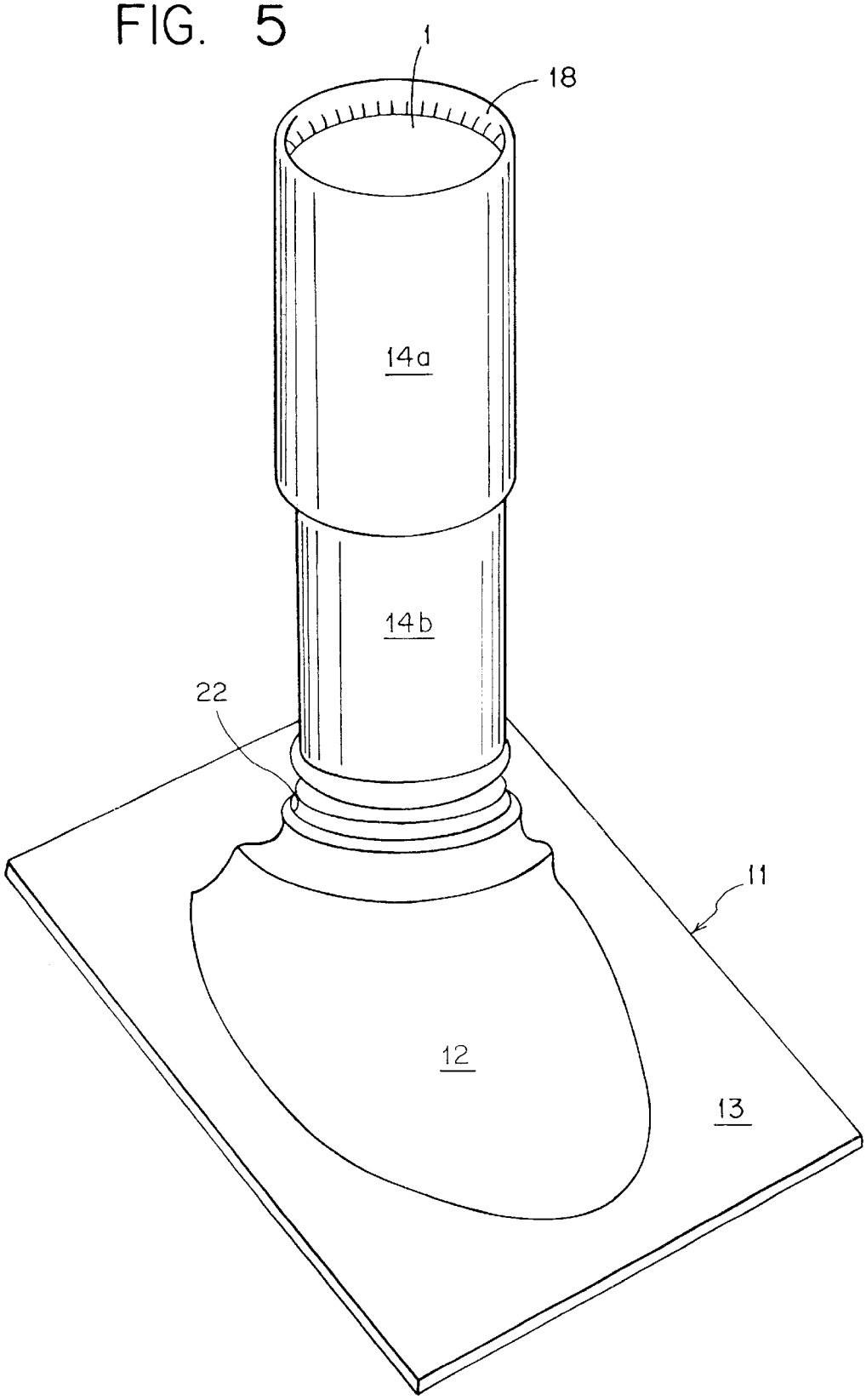
FIG. 5 is a perspective view of a third embodiment of the invention.

According to either embodiment, multiple (telescoping) sleeve portions may be provided and (optionally) coupled to each other by crimping, if need be arranged with the larger diameter sleeve 14*a* covering the upper portion of the vent pipe and the upper end of the lower smaller diameter sleeve 14*b* which is attached to gasket 22. An example is shown in FIG. 5, wherein vent pipe 14*a* and 14*b* are shown telescopically arranged. According to either embodiment of the invention, the components are preferably color matched and made available in a variety of sizes to fit different size vent pipes.

One of the advantages of the invention is that the horizontal sealing required by the prior art gasket is replaced by a vertical sealing among the pipe, the sleeve via the rubber boot which provides a watertight connection without the need for adhesives or sealants. This vertical sealing is less prone to separating as it is held in place by gravity, is not affected by expansion and contraction, and is aesthetically pleasing. In both embodiments, an elastomeric vertical expansion and sealing member 22, 122, is provided between the lower flange (13, 113) and the sleeve (11, 111) and horizontal covering means (18, 126) is provided to cover the space between the upper ends of the sleeve and the vent pipe. As a result of this constructions, any water will simply flow over the rubber boot or gasket 122, over its rubber skirt 124 and onto the roof flashing (i.e., covering the lower flange 111)

There have been described and illustrated herein several embodiments of a full coverage vent pipe flashing system. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A vent pipe flashing system, comprising:

a) a lower flange including means for residing beneath roofing material;

b) an upper sleeve means for covering substantially the entire exposed length of vent pipe;

c) elastomeric vertical expansion means coupled to and interconnecting said flange and said sleeve means; and d) horizontal covering means for covering the upper ends of said upper sleeve means and the vent pipe.

2. A vent pipe flashing system according to claim 1, wherein:

said lower flange comprises a central hub having a central opening and an outer, generally planar, peripheral flange which peripheral flange serves as said means for covering:

said upper sleeve means comprises a metal tube, said elastomeric vertical expansion means comprises a flexible boot, and said horizontal covering means comprises an upper flanged portion of said upper sleeve means.

3. A vent pipe flashing system according to claim 2, wherein:

said upper sleeve has a substantially J-shaped flange at its lower end, said central hub of said lower flange is provided with an upper end having a substantially inverted-J-shaped flange, and said substantially C-shaped boot engages said substantially J-shaped flange and said substantially inverted-J-shaped flange.

4. A vent pipe flashing system according to claim 3, wherein:

said upper flanged portion of said upper sleeve means is a substantially inverted-J-shaped flange.

5. A vent pipe flashing system according to claim 1, wherein:

said lower flange comprises a raised center hub having a central opening and an outer generally planar, peripheral flange, said upper sleeve means comprises a tube, said elastomeric vertical expansion means comprises a gasket with a skirt, and said horizontal covering means comprises a functionally mounted end cap having a substantially inverted-U-shaped section.

6. A vent pipe flashing system according to claim 5, wherein:

a lower end of said tube is fixedly coupled to said gasket.

7. A vent pipe flashing system according to claim 6, wherein:

an upper end of said hub is fixedly coupled to said gasket.

8. A vent pipe flashing system according to claim 6, wherein:

said lower end of said tube is crimped to said gasket.

9. A vent pipe flashing system according to claim 8, wherein:

said upper end of said hub is crimped to said gasket.

* * * * *